US012728339B2

(12) United States Patent
Lin

(10) Patent No.: US 12,728,339 B2
(45) Date of Patent: Sep. 8, 2026

(54) PULL-UP FRAME

(71) Applicant: Jianchao Lin, Yongkang (CN)

(72) Inventor: Jianchao Lin, Yongkang (CN)

( * ) Notice: Subject to any disclaimer, the term of this patent is extended or adjusted under 35 U.S.C. 154(b) by 70 days.

(21) Appl. No.: 18/919,890

(22) Filed: Oct. 18, 2024

(65) Prior Publication Data

US 2026/0108794 A1 Apr. 23, 2026

(51) Int. Cl.
*A63B 71/04* (2006.01)
*A63B 23/12* (2006.01)

(52) U.S. Cl.
CPC ..... *A63B 71/04* (2013.01); *A63B 23/1218* (2013.01); *A63B 2210/50* (2013.01)

(58) Field of Classification Search
CPC . A63B 71/04; A63B 23/1218; A63B 2210/50; A63B 21/068; A63B 1/00; A63B 23/03525; A63B 21/4035; A63B 2209/00; B24C 1/06
See application file for complete search history.

(56) References Cited

U.S. PATENT DOCUMENTS 1,229,537 A * 6/1917 Sisbower ..... A45F 3/24 5/127
2014/0152063 A1* 6/2014 Huang ..... A45F 3/24 211/204
2022/0143446 A1* 5/2022 Phillips ..... A63B 21/068
2022/0379165 A1* 12/2022 Alfandre ..... A63B 21/00047

FOREIGN PATENT DOCUMENTS

DE 202022102669 U1 * 6/2022 ..... A63B 23/1236

* cited by examiner

*Primary Examiner* — Andrew M Kobylarz

(57) ABSTRACT

The application relates to the technical field of sports equipment and specifically discloses a pull-up frame, comprising an exercise device and a support base, wherein the exercise device includes a first connecting frame and a second connecting frame, wherein the first connecting frame and the second connecting frame are both connected to the support base. The support base comprises a first supporting mechanism and a second supporting mechanism. Through the above technical scheme, when the user stores the folded pull-up frame, the user completely pulls out the first locking member and the second locking member, rotates the first supporting mechanism and the second supporting mechanism, drives the first connecting member and the second connecting member to rotate, so that the first sliding member slides on the first connecting frame, and the second sliding member slides on the second connecting frame.

7 Claims, 10 Drawing Sheets

PULL-UP FRAME

FIELD OF THE APPLICATION

The application relates to the technical field of sports equipment, in particular to a pull-up frame.

BACKGROUND

Nowadays, people prioritize physical health. For those with a fast-paced lifestyle, home fitness aligns with modern life. Pull-ups, for example, are a popular exercise. Regular practice can effectively increase muscle strength and improve coordination.

Pull-up frames have become available on the market for indoor use. This allows users to exercise at any time without being limited by time and location, making daily training much more convenient. However, traditional pull-up frames are large and cannot be completely folded, so they still take up a lot of space even when folded. This makes it very inconvenient for users to move or store the pull-up frames.

SUMMARY

To solve the aforementioned issues, the application introduces a pull-up frame that addresses the problem of the traditional pull-up frame taking up significant space when folded.

The technical solution comprises a pull-up frame, which consists of an exercise device and a support base. The exercise device comprising a first connecting frame and a second connecting frame, both connected to the support base. The support base comprises a first supporting mechanism and a second supporting mechanism. The first supporting mechanism is rotatably connected to the end of the first connecting frame, and the second supporting mechanism is rotatably connected to the end of the second connecting frame. A first sliding member is placed on the first connecting frame, and a second sliding member is placed on the second connecting frame. The first sliding member and the first supporting mechanism are connected to the first connecting frame, and the second sliding member and the second supporting mechanism are connected to the second connecting frame. A first locking member is used to fix the first sliding member, and a second locking member is used to fix the second sliding member. The cross-sectional shape of the first connecting frame is non-circular, and the first sliding member is equipped with a first specially shaped hole to match the first connecting frame. Similarly, the cross-sectional shape of the second connecting frame is non-circular, and the second sliding member is provided with a second specially shaped hole to match the second connecting frame.

Through the above technical solution, when the user stores the foldable pull-up frame, the user completely pulls out the first locking member and the second locking member, rotates the first supporting mechanism and the second supporting mechanism, drives the first connecting member and the second connecting member to rotate, so that the first sliding member slides on the first connecting frame, and the second sliding member slides on the second connecting frame. After the first sliding member and the second sliding member reach the limit distance, the first locking member is used to fix the first sliding member, the second locking member is used to fix the second sliding member, and the storage of the pull-up frame is completed; the first connecting frame is inserted into the first special-shaped hole of the first sliding member, and the second connecting frame is inserted into the second special-shaped hole of the second sliding member, so that the overall structure of the pull-up frame is very compact, and the volume after the storage is smaller, which is convenient for users to store and move.

Through the above technical solution, the user slides the first sliding member to the position of the first limiting hole, the second sliding member to the position of the third limiting hole, the first locking member passes through the first mounting hole and the first limiting hole to engage, and the second locking member passes through the second mounting hole and the third limiting hole to engage, and the pull-up frame is fully unfolded; slide the first sliding member to the position of the second limiting hole, the second sliding member to the position of the fourth limiting hole, the first locking member passes through the first mounting hole and the second limiting hole to engage, and the second locking member passes through the second mounting hole and the fourth limiting hole to engage, and the pull-up frame is stored, making the deployment and storage of the pull-up frame very convenient and more convenient to use.

Further, the first connecting member and the second connecting member are both frame-shaped, the first connecting member comprising a first rotating shaft, a second rotating shaft, a first connecting piece and a second connecting piece, two ends of the first connecting piece are respectively rotatably connected to the first rotating shaft and the second rotating shaft, two ends of the second connecting piece are respectively rotatably connected to the first rotating shaft and the second rotating shaft, the first rotating shaft is penetrated on the first sliding member, the second rotating shaft is penetrated on the first supporting mechanism, the first connecting piece is located on one side of the first sliding member and the first supporting mechanism, and the second connecting piece is located on the other side of the first sliding member and the first supporting mechanism; the second connecting member comprising a third rotating shaft, a fourth rotating shaft, a third connecting piece and a fourth connecting piece, two ends of the third connecting piece are respectively rotatably connected to the third rotating shaft and the fourth rotating shaft, two ends of the fourth connecting piece are respectively rotatably connected to the third rotating shaft and the fourth rotating shaft, the third rotating shaft is penetrated on the second sliding member, the fourth rotating shaft is penetrated on the second supporting mechanism, the third connecting piece is located on one side of the second sliding member and the second supporting mechanism, and the fourth connecting piece is located on the other side of the second sliding member and the second supporting mechanism.

The technical solution described above involves positioning the first connecting piece of the first connecting member on one side of the first sliding member and the first supporting mechanism, and the second connecting piece on the other side. Similarly, the third connecting piece of the second connecting member is located on one side of the second sliding member and the second supporting mechanism, while the fourth connecting piece is located on the other side. This arrangement allows the first and second connecting pieces to be stored on the outside of the first supporting mechanism and the first sliding member, and the third and fourth connecting pieces to be stored on the outside of the second supporting mechanism and the second sliding member. As a result, the distance between the supporting mechanisms and the sliding members is greatly reduced, making the folded pull-up frame more compact and easier to store and move.

The first supporting mechanism comprising a first hollow rod and a second hollow rod, both of which are rotatably connected to the two sides of the first connecting frame. The second supporting mechanism comprises a third hollow rod and a fourth hollow rod, which are also rotatably connected to the two sides of the second connecting frame. When the first and second supporting mechanisms are fully unfolded, all the hollow rods are located on the same plane.

By utilizing the technical solution mentioned above, the positioning of the first and second hollow rods significantly increases the load-bearing area of the first support mechanism, thereby enhancing its overall load-bearing capacity. Similarly, the positioning of the third and fourth hollow rods significantly increases the load-bearing area of the second support mechanism, thereby improving its overall load-bearing capacity. When the pull-up frame is fully extended, the first, second, third, and fourth hollow rods are all situated on the same plane, ensuring greater stability for the frame's support base as a whole.

When fully extended, the first supporting mechanism and the second supporting mechanism form an obtuse angle between the first hollow rod and the second hollow rod, as well as between the third hollow rod and the fourth hollow rod. Additionally, the opening direction of the angle formed by the first hollow rod and the second hollow rod is opposite to the opening direction of the angle formed by the third hollow rod and the fourth hollow rod.

The support area created by the fully unfolded first, second, third, and fourth hollow rods is larger. The angle formed by the first and second hollow rods is obtuse, as is the angle formed by the third and fourth hollow rods. This design effectively prevents the pull-up frame from easily tilting during use, making the frame more stable overall.

In addition, there are two first connecting members that are rotatably connected to the first hollow rod and the second hollow rod respectively. There are also two second connecting members that are rotatably connected to the third hollow rod and the fourth hollow rod respectively.

The first two connecting members are rotatably connected to the first hollow rod and the second hollow rod, respectively. This ensures a more secure connection between the first supporting mechanism and the first sliding member, with more uniform force. Similarly, the two second connecting members are rotatably connected to the third hollow rod and the fourth hollow rod, respectively, ensuring a more secure connection between the second supporting mechanism and the second sliding member, with more uniform force.

In addition, the first connecting frame has a first mounting rod, and the second connecting frame has a second mounting rod. At the end of the first mounting rod, there is a positioning piece that is fixedly connected. The positioning piece and the second mounting rod are connected in a way that allows them to rotate, and there is a locking column that is commonly provided on the positioning piece and the second mounting rod.

By using the technical solution described above, the user can disassemble the components of the exercise device. This allows them to completely pull out the locking column and rotate the first mounting rod and the second mounting rod in order to fold the first connecting frame and the second connecting frame. As a result, the volume of the pull-up frame after folding is further reduced, saving space in storage.

Furthermore, the second hollow rod and the fourth hollow rod each have handles for holding.

With the technical solution described above, the user can easily use the handle to apply force to the second and fourth hollow rods, expanding and storing the pull-up frame. This makes it more convenient and labor-saving for the user.

Foot pads are provided at the bottom of the first and second connecting frames, as well as the first, second, third, and fourth hollow rods.

By using the foot pads in the technical solution described above, we can increase the friction between the pull-up frame and the ground. This will prevent the pull-up frame from slipping during use and also provide a buffering effect, reducing the damage caused to the ground during the user's exercise.

BRIEF DESCRIPTION OF THE DRAWINGS

The technology may be more completely understood in connection with the following drawings, in which.

As show in FIGS. 1-10

Figure 1:
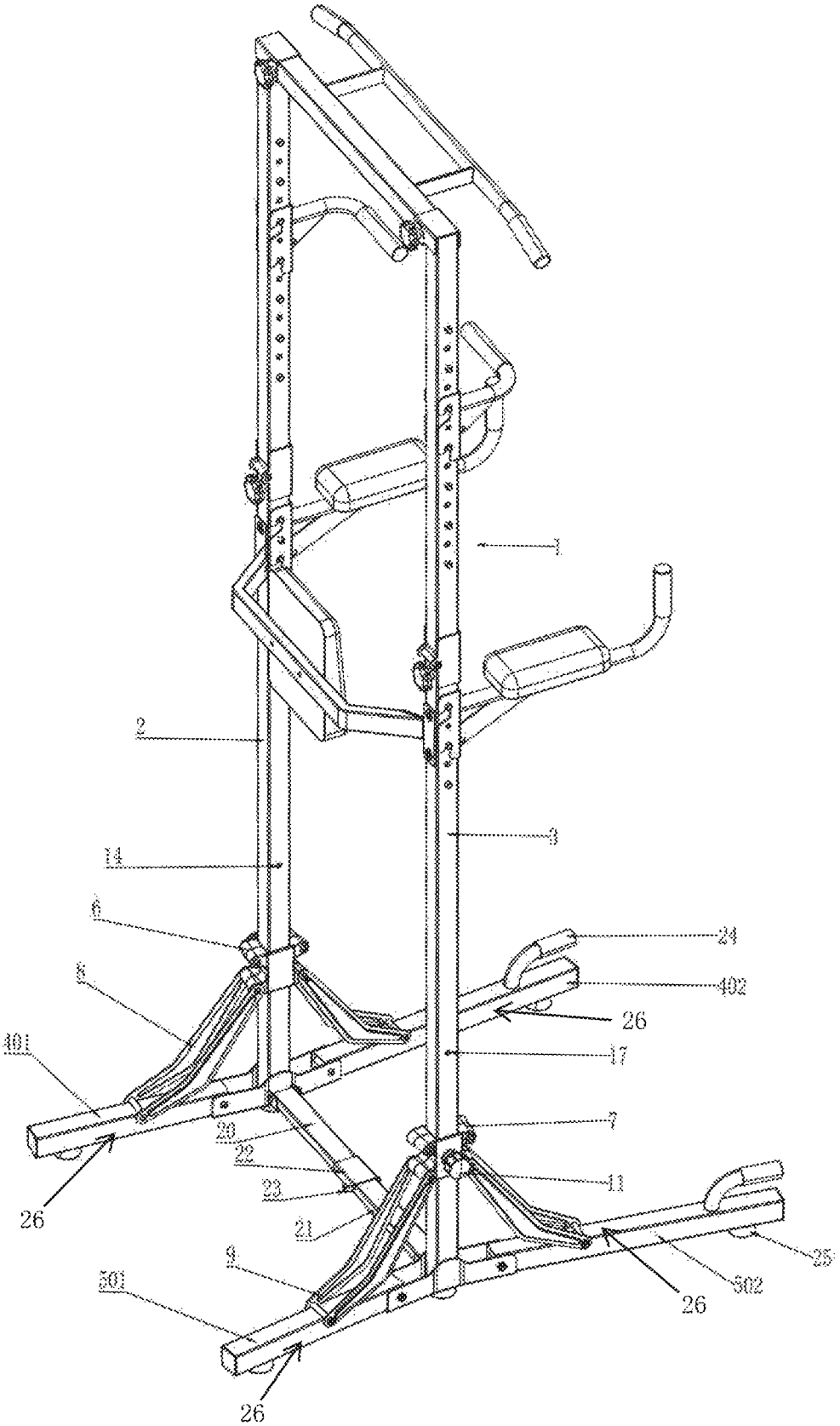
FIG. 1 is a perspective view of the pull-up frame, according to an embodiment.

1. Exercise device;
2. First connecting frame;
3. Second connecting frame;
4. First supporting mechanism;
401. First hollow rod;
402. Second hollow rod;
5. Second supporting mechanism;
501. Third hollow rod;
502. Fourth hollow rod;
6. First sliding member;
7. Second sliding member;
8. First connecting member;
801. First rotating shaft;
802. Second rotating shaft;
803. First connecting piece;
804. Second connecting piece;
9. Second connecting member;
901. Third rotating shaft;
902. fourth rotating shaft;
903. third connecting piece;
904. fourth connecting piece;
10. first locking member;
11. second locking member;
12. first special-shaped hole;
13. second special-shaped hole;
14. first limiting hole;
15. second limiting hole;
16. first mounting hole;

17. third limiting hole;
18. fourth limiting hole;
19. second mounting hole;
20. first mounting rod;
21. second mounting rod;
22. positioning piece;
23. locking column;
24. handle;
25. foot pad While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

As shown in FIGS. 1-10, a pull-up frame comprising an exercise device 1 and a support base. The exercise device 1 comprising a first connecting frame 2 and a second connecting frame 3. The first connecting frame 2 and the second connecting frame 3 are both connected to the support base. The support base comprising a first supporting mechanism 4 and a second supporting mechanism 5. The first supporting mechanism 4 is rotatably connected to the end of the first connecting frame 2, and the second supporting mechanism 5 is rotatably connected to the end of the second connecting frame 3. The first connecting frame 2 is provided with a first sliding member 6, and the second connecting frame 3 is provided with a second sliding member 7. The first sliding member 6 and the first supporting mechanism 4 are connected to the first connecting frame 2 and the second connecting frame 3. A first connecting member 8 is rotatably connected, and a second connecting member 9 is rotatably connected to the second sliding member 7 and the second supporting mechanism 5. A first locking member 10 for fixing the first sliding member 6 is provided on the first sliding member 6, and a second locking member 11 for fixing the second sliding member 7 is provided on the second sliding member 7; the cross-sectional shape of the first connecting frame 2 is a non-circular shape, and a first special-shaped hole 12 for matching the first connecting frame 2 is provided on the first sliding member 6. The cross-sectional shape of the second connecting frame 3 is a non-circular shape, and a second special-shaped hole 13 for matching the second connecting frame 3 is provided on the second sliding member 7. When the user stores the foldable pull-up frame, the user completely pulls out the first locking member 10 and the second locking member 11, rotates the first supporting mechanism 4 and the second supporting mechanism 5, drives the first connecting member 8 and the second connecting member 9 to rotate, so that the first sliding member 6 slides on the first connecting frame 2, and the second sliding member 7 slides on the second connecting frame 3. After the first sliding member 6 and the second sliding member 7 reach the limit distance, the first locking member 10 is used to fix the first sliding member 6, and the second locking member 11 is used to fix the second sliding member 7, and the storage of the pull-up frame is completed; the first connecting frame 2 is inserted into the first special-shaped hole 12 of the first sliding member 6, and the second connecting frame 3 is inserted into the second special-shaped hole 13 of the second sliding member 7, so that the overall structure of the pull-up frame is very compact, and the volume after storage is smaller, which is convenient for users to store and move.

As shown in FIGS. 1, 2, 5-8, the first connecting frame 2 is provided with a first limiting hole 14 and a second limiting hole 15, and the first sliding member 6 is provided with a first mounting hole 16 for the first locking member 10 to pass through, and the first locking member 10 can be engaged with the first limiting hole 14 or the second limiting hole 15; the second connecting frame 3 is provided with a third limiting hole 17 and a fourth limiting hole 18, and the second sliding member 7 is provided with a second mounting hole 19 for the second locking member 11 to pass through, and the second locking member 11 can be engaged with the third limiting hole 17 or the fourth limiting hole 18. The user slides the first sliding member 6 to the position of the first limiting hole 14, the second sliding member 7 to the position of the third limiting hole 17, the first locking member 10 passes through the first mounting hole 16 and is engaged with the first limiting hole 14, and the second locking member 11 passes through the second mounting hole 19 and is engaged with the third limiting hole 17, and the pull-up frame is fully deployed; the first sliding member 6 is slid to the position of the second limiting hole 15, the second sliding member 7 is slid to the position of the fourth limiting hole 18, the first locking member 10 passes through the first mounting hole 16 and is engaged with the second limiting hole 15, and the second locking member 11 passes through the second mounting hole 19 and is engaged with the fourth limiting hole 18, and the pull-up frame is stored, so that the deployment and storage of the pull-up frame are very convenient and more convenient to use.

As shown in FIGS. 1, 2, 9 and 10, the first connecting member 8 and the second connecting member 9 are both frame-shaped. The first connecting member 8 includes a first rotating shaft 801, a second rotating shaft 802, a first connecting piece 803 and a second connecting piece 804. The two ends of the first connecting piece 803 are respectively rotatably connected to the first rotating shaft 801 and the second rotating shaft 802, and the two ends of the second connecting piece 804 are respectively rotatably connected to the first rotating shaft 801 and the second rotating shaft 802. The first rotating shaft 801 is penetrated on the first sliding member 6, and the second rotating shaft 802 is penetrated on the first supporting mechanism 4. The first connecting piece 803 is located on one side of the first sliding member 6 and the first supporting mechanism 4, and the second connecting piece 804 is located on the first sliding member 6 and the first supporting mechanism 4. The other side of the support mechanism 4; the second connecting member 9 includes a third rotating shaft 901, a fourth rotating shaft 902, a third connecting piece 903 and a fourth connecting piece 904, the two ends of the third connecting piece 903 are respectively rotatably connected to the third rotating shaft 901 and the fourth rotating shaft 902, the two ends of the fourth connecting piece 904 are respectively rotatably connected to the third rotating shaft 901 and the fourth rotating shaft 902, the third rotating shaft 901 is penetrated by the second sliding member 7, the fourth rotating shaft 902 is penetrated by the second supporting mechanism 5, the third connecting piece 903 is located on one side of the second sliding member 7 and the second supporting mechanism 5, and the fourth connecting piece 904 is located on the other side of the second sliding member 7 and the second supporting mechanism 5. The first connecting piece 803 of the first connecting member 8 is located on one side of the first sliding member 6 and the first supporting mechanism 4, the second connecting piece 804 is located on the other side of the first sliding member 6 and the first supporting mechanism 4, the third connecting piece 903 of the second connecting piece 804 is located on one side of the second sliding member 7 and the second supporting mechanism 5, and the fourth connecting piece 904 is located on the other side of the second sliding member 7 and the second supporting mechanism 5, so that after the user completely folds the pull-up frame, the first connecting piece 803 and the second connecting piece 804 can be stored on the outside of the first supporting mechanism 4 and the first sliding member 6, and the third connecting piece 903 and the fourth connecting piece 904 can be stored on the outside of the second supporting mechanism 5 and the second sliding member 7, which greatly reduces the distance between the first supporting mechanism 4 and the first sliding member 6 and the distance between the second supporting mechanism 5 and the second sliding member 7, so that the pull-up frame after folding and storage is more compact and smaller in size, and is easier for the user to store and move.

Figure 2:
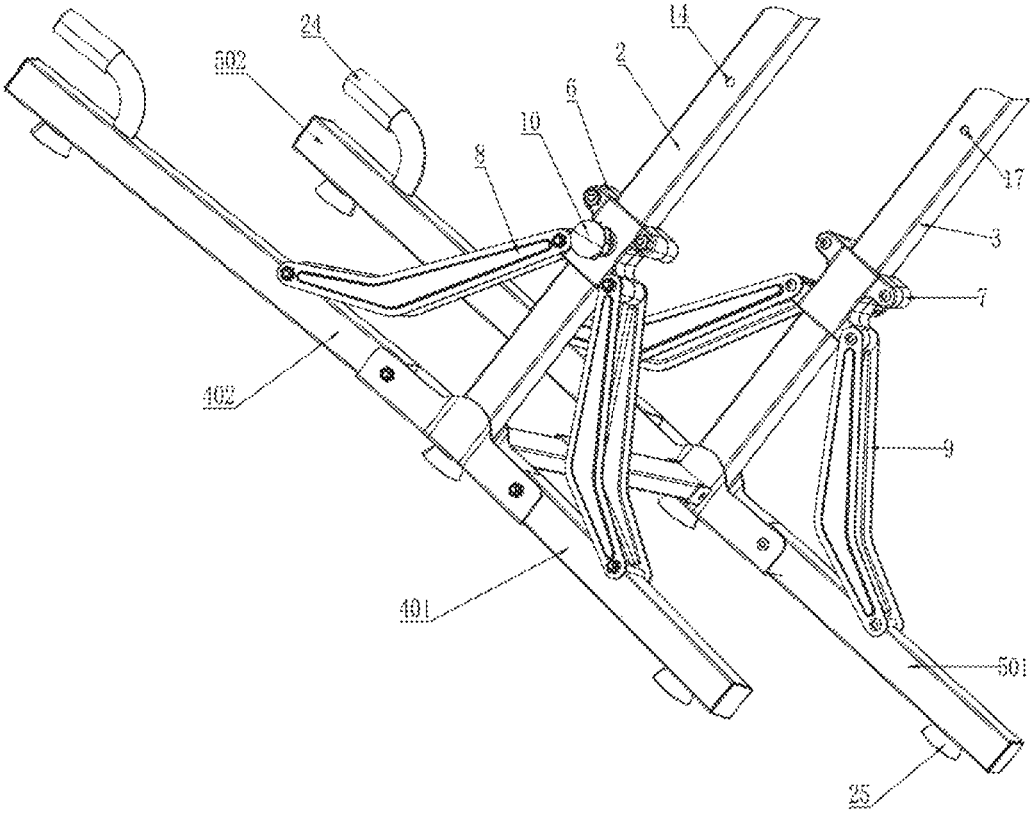
FIG. 2 is a perspective view of a partial structure, according to an embodiment.
Figure 3:
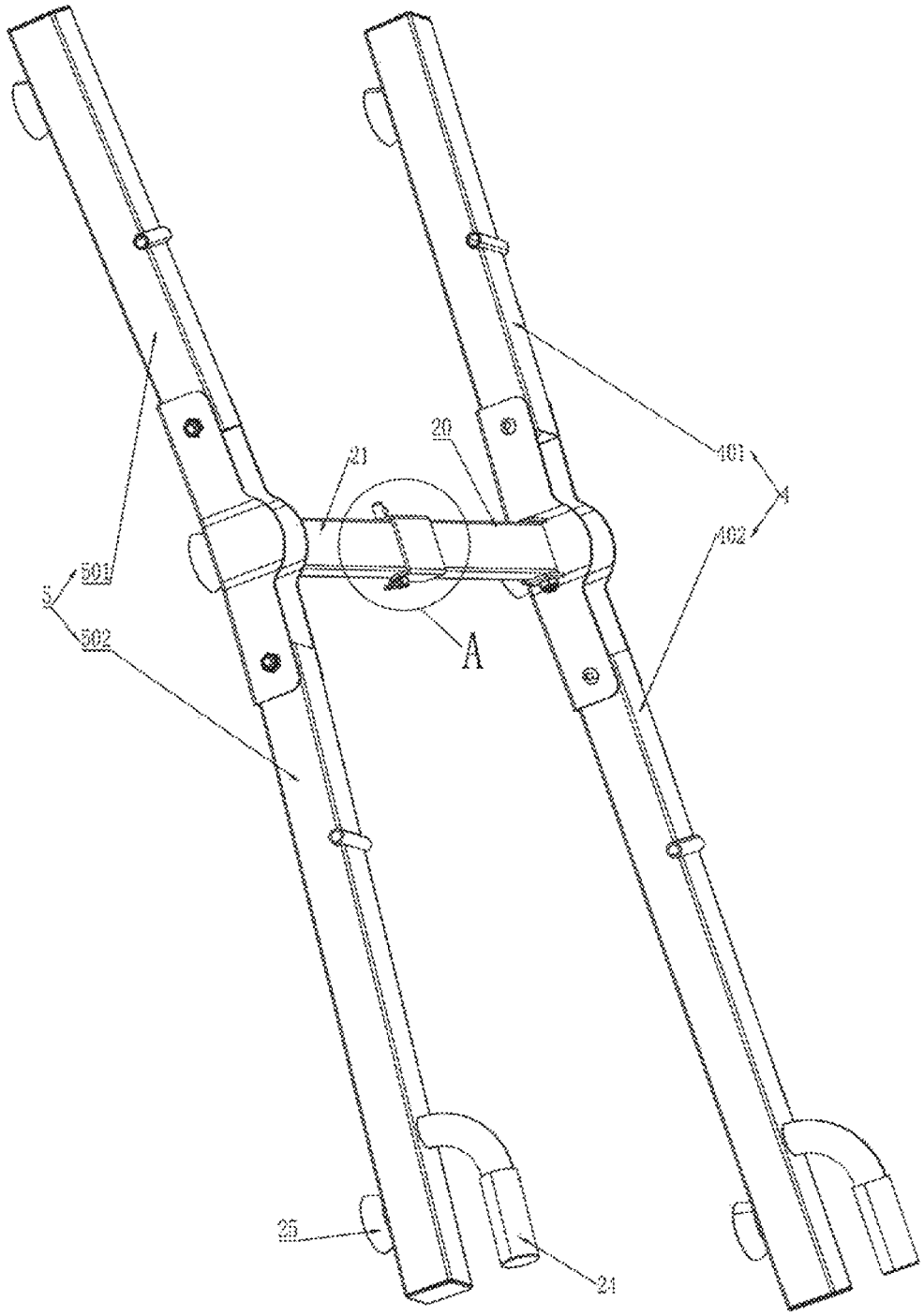
FIG. 3 is another perspective view of a partial structure, according to an embodiment.
Figure 4:
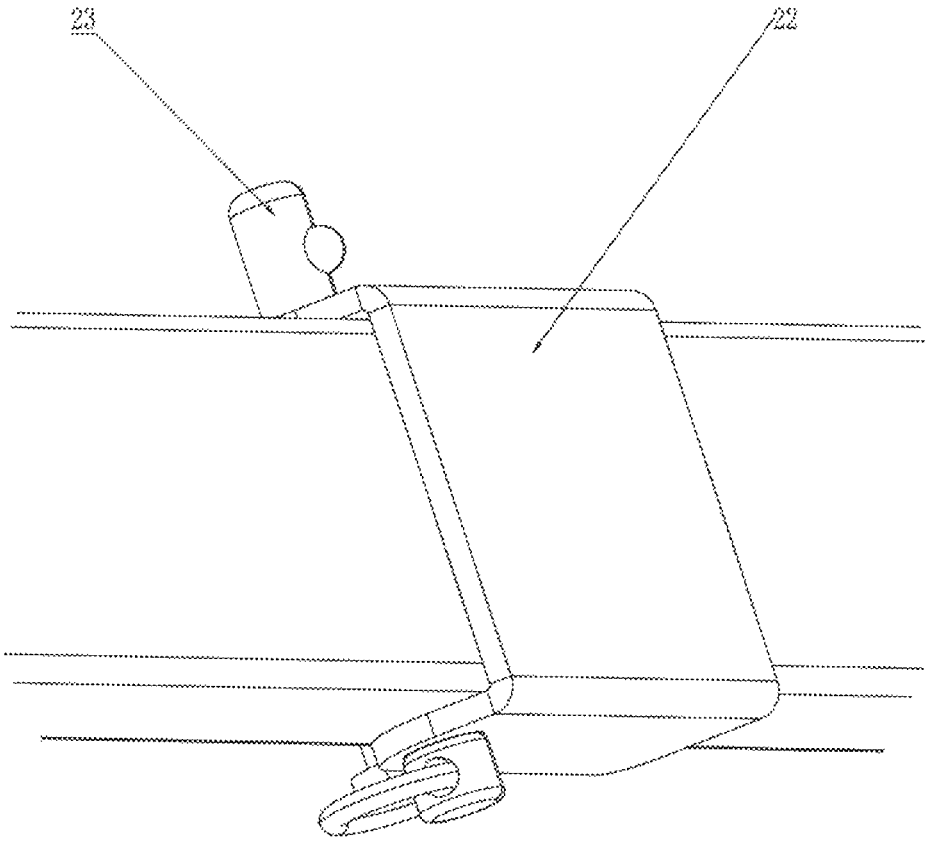
FIG. 4 is an enlarged view of, of circled portion A, of FIG. 3.
Figure 5:
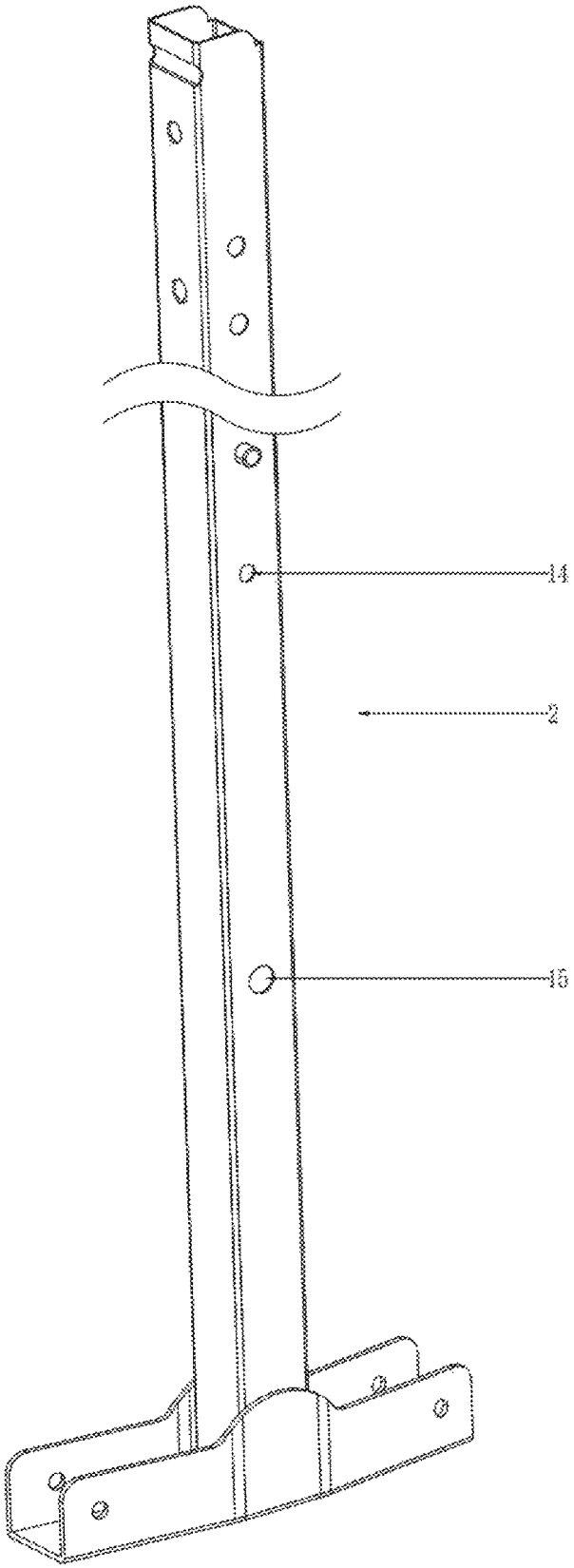
FIG. 5 is a perspective view of the first connecting frame, according to an embodiment.
Figure 6:
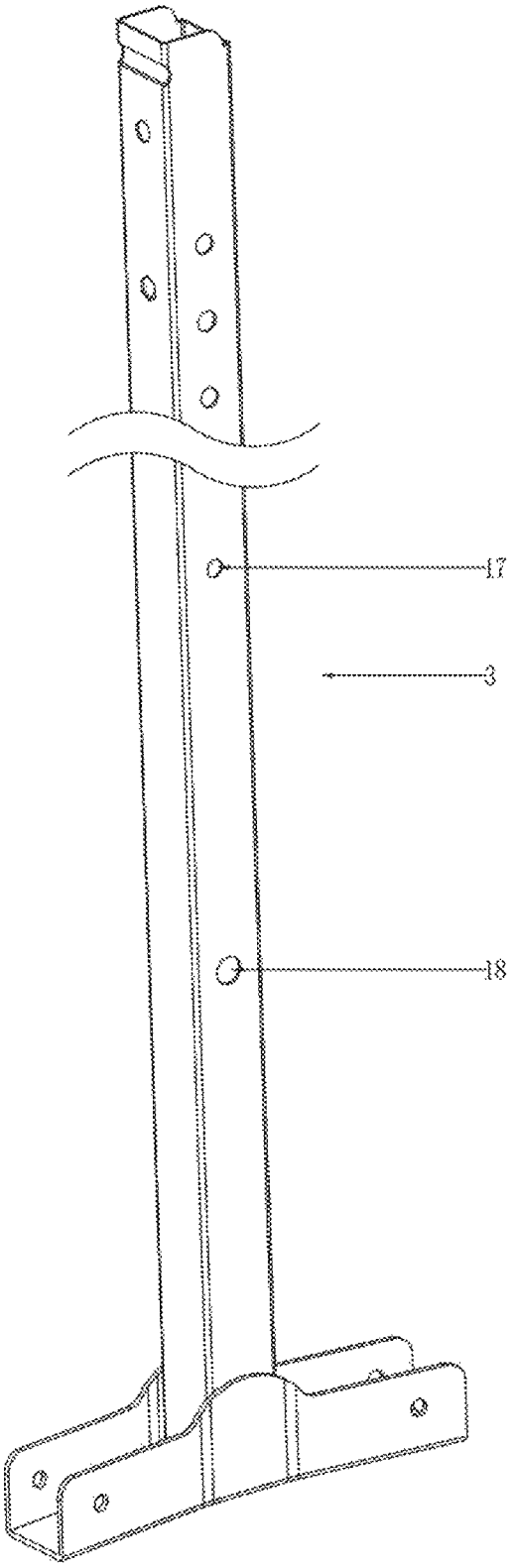
FIG. 6 is a perspective view of the second connecting frame, according to an embodiment.
Figure 7:
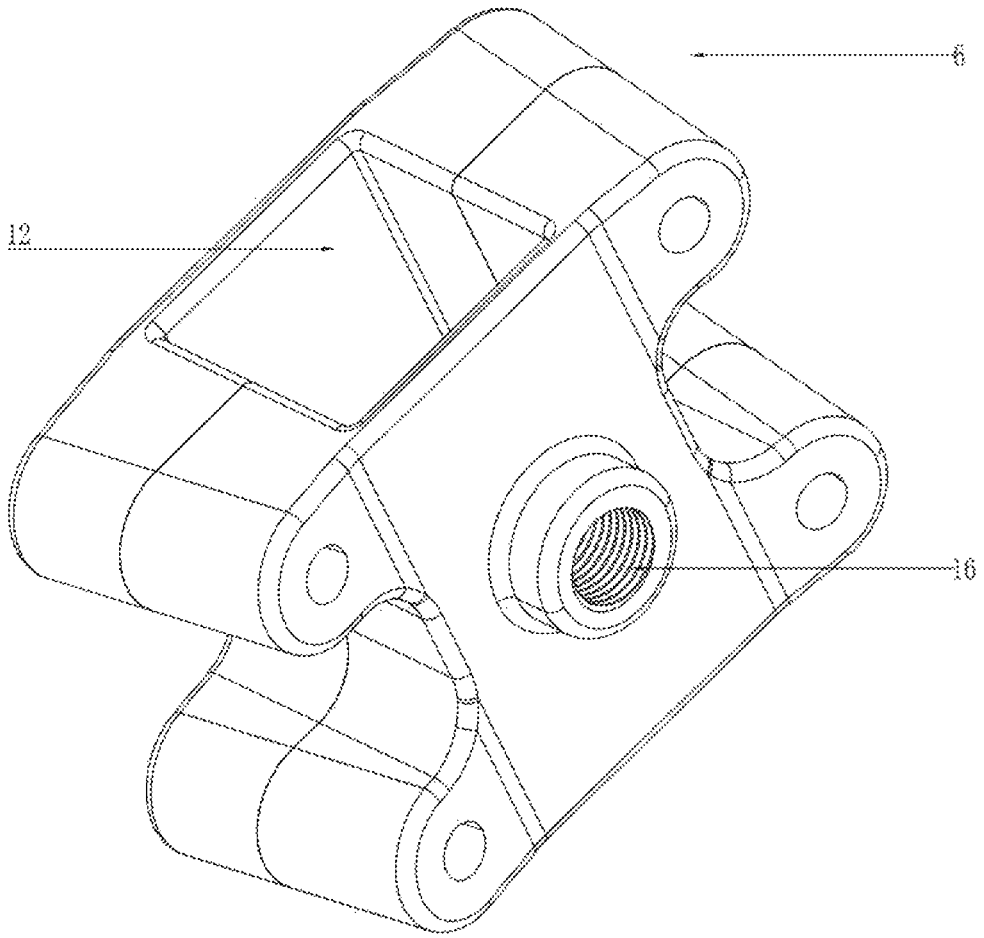
FIG. 7 is a perspective view of the first sliding member, according to an embodiment.
Figure 8:
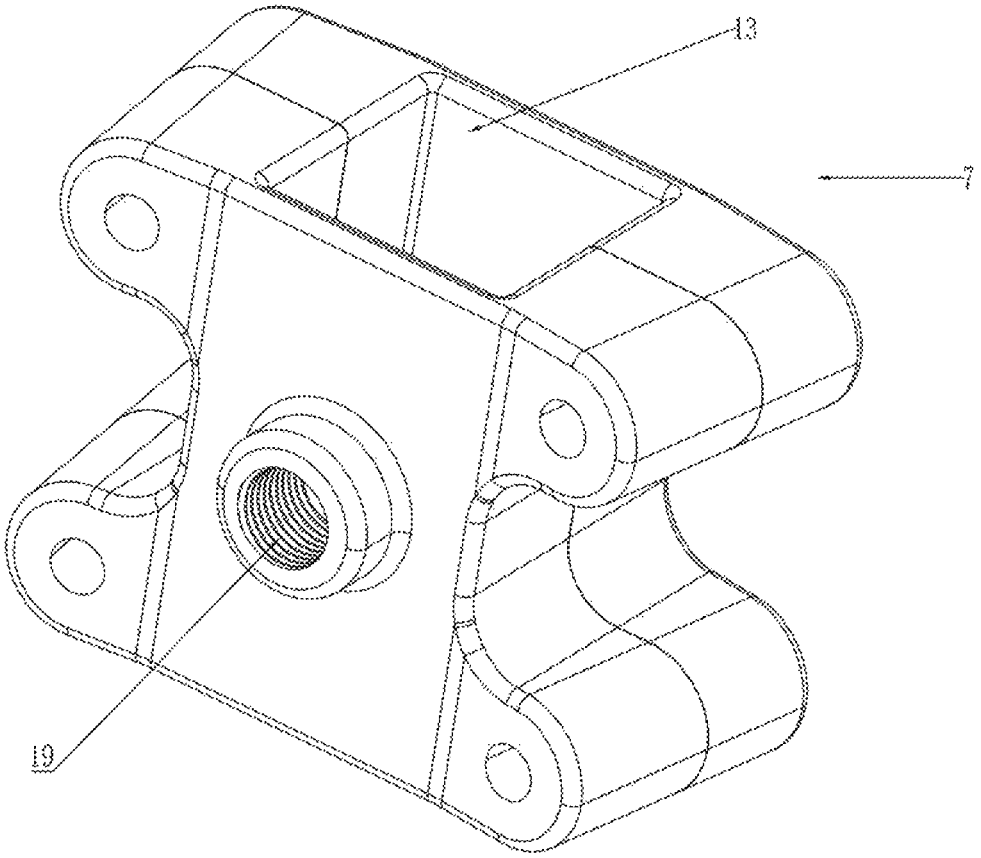
FIG. 8 is a perspective view of the second sliding member, according to an embodiment.
Figure 9:
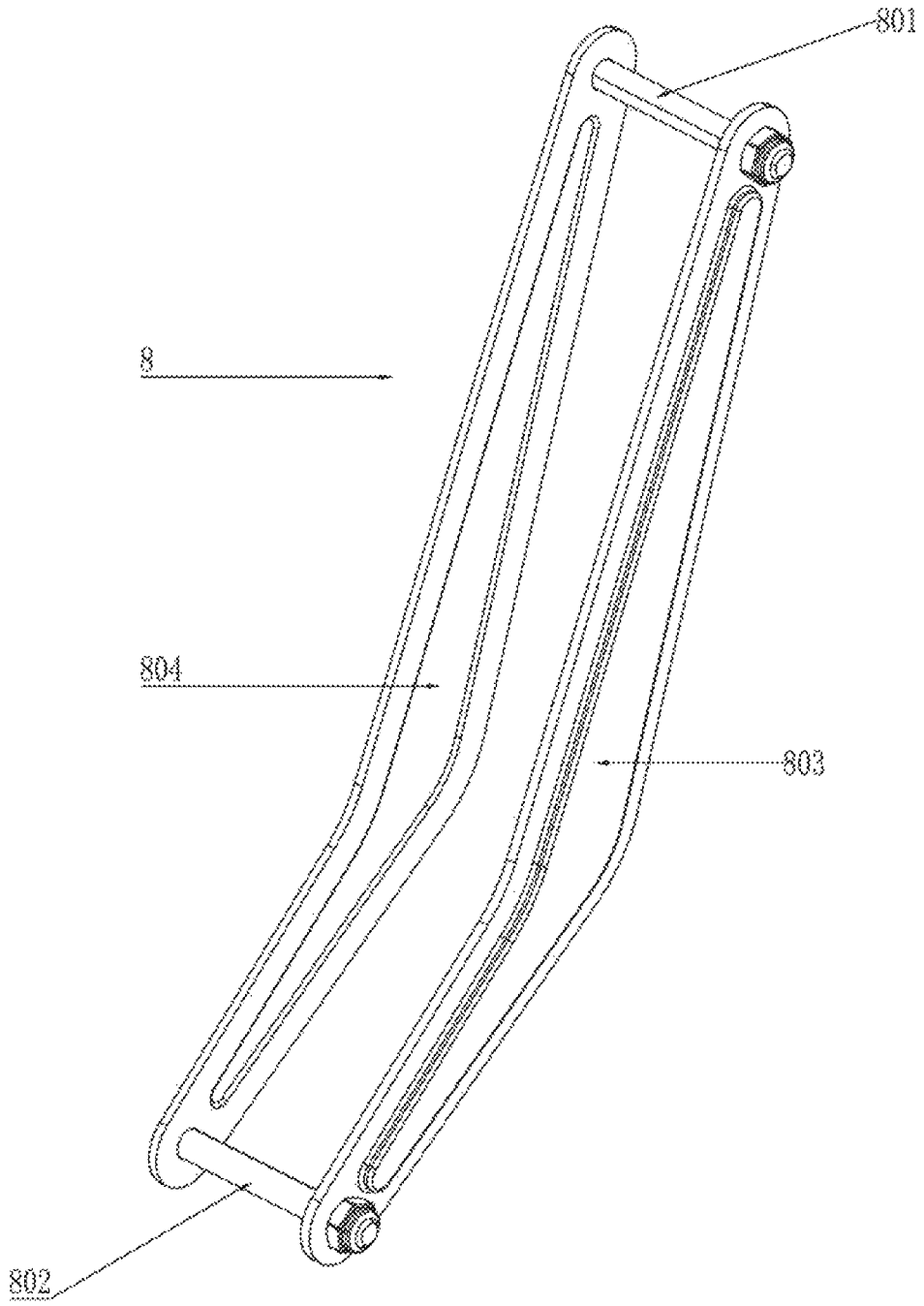
FIG. 9 is a perspective view of the first connecting member, according to an embodiment.
Figure 10:
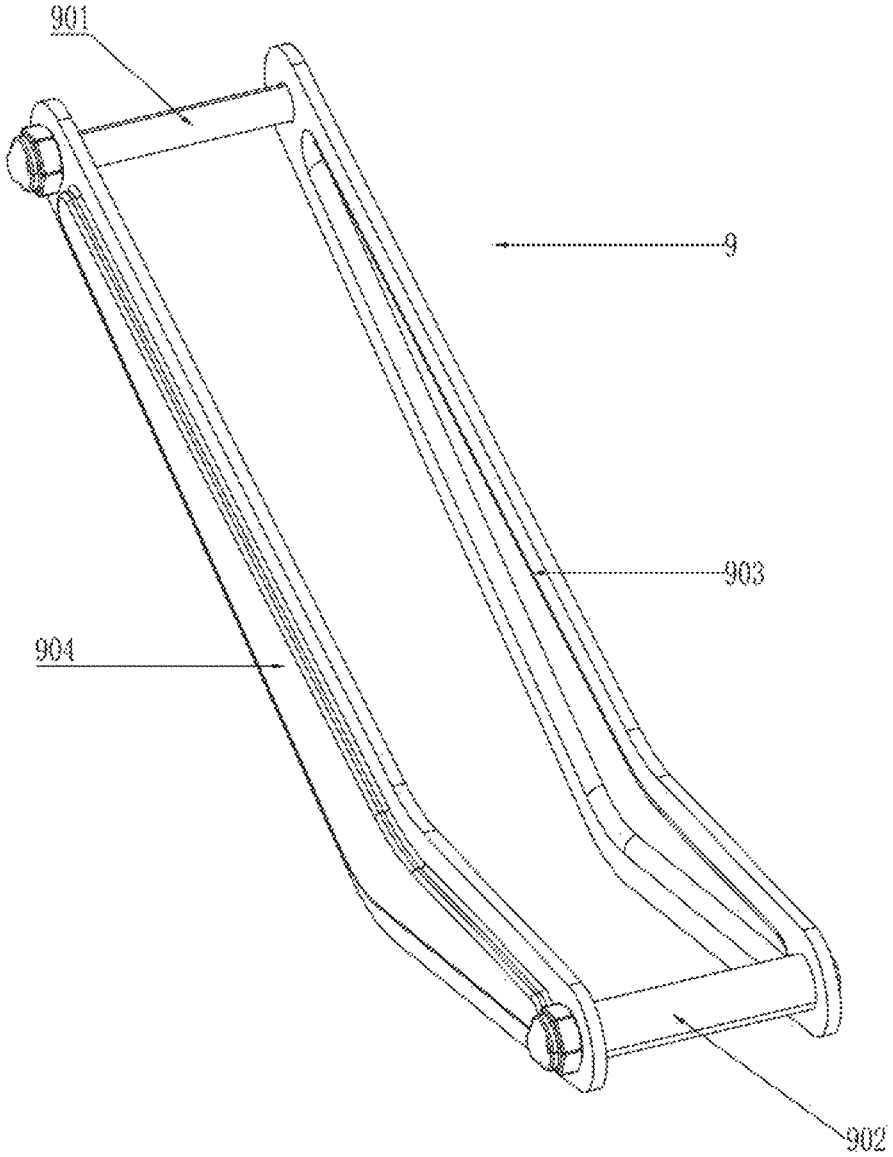
FIG. 10 is a perspective view of the second connecting member, according to an embodiment.

As shown in FIGS. 1-3, the first supporting mechanism 4 includes a first hollow rod 401 and a second hollow rod 402, which are rotatably connected to both sides of the first connecting frame 2 respectively; the second supporting mechanism 5 includes a third hollow rod 501 and a fourth hollow rod 502, which are rotatably connected to both sides of the second connecting frame 3 respectively; when the first supporting mechanism 4 and the second supporting mechanism 5 are fully unfolded, the first hollow rod 401, the second hollow rod 402, the third hollow rod 501 and the fourth hollow rod 502 are all located on the same plane. The arrangement of the first hollow rod 401 and the second hollow rod 402 greatly increases the force-bearing area of the first support mechanism 4, thereby improving the overall bearing capacity of the first support mechanism 4; the arrangement of the third hollow rod 501 and the fourth hollow rod 502 greatly increases the force-bearing area of the second support mechanism 5, thereby improving the overall bearing capacity of the second support mechanism 5; the first hollow rod 401, the second hollow rod 402, the third hollow rod 501 and the fourth hollow rod 502 are all located on the same plane when the pull-up frame is fully unfolded, thereby making the support base of the pull-up frame more stable as a whole.

As shown in FIGS. 1-3, when the first supporting mechanism 4 and the second supporting mechanism 5 are fully deployed, the angle formed by the first hollow rod 401 and the second hollow rod 402 is obtuse, the angle formed by the third hollow rod 501 and the fourth hollow rod 502 is obtuse, and the opening direction of the angle formed by the first hollow rod 401 and the second hollow rod 402 is opposite to the opening direction of the angle formed by the third hollow rod 501 and the fourth hollow rod 502. The support area formed by the first hollow rod 401, the second hollow rod 402, the third hollow rod 501 and the fourth hollow rod 502 after being fully deployed is larger, the angle formed by the first hollow rod 401 and the second hollow rod 402 is an obtuse angle, and the angle formed by the third hollow rod 501 and the fourth hollow rod 502 is an obtuse angle, which effectively avoids the pull-up frame from being easily tilted as a whole during use, making the pull-up frame more stable as a whole.

As shown in FIGS. 1 and 2, there are two first connecting members 8, and the two first connecting members 8 are rotatably connected to the first hollow rod 401 and the second hollow rod 402 respectively; there are two-second connecting members 9, and the two-second connecting members 9 are rotatably connected to the third hollow rod 501 and the fourth hollow rod 502 respectively. The two first connecting members 8 are rotatably connected to the first hollow rod 401 and the second hollow rod 402 respectively so that the connection between the first supporting mechanism 4 and the first sliding member 6 is more secure and the force is more evenly applied; the two-second connecting members 9 are rotatably connected to the third hollow rod 501 and the fourth hollow rod 502 respectively so that the connection between the second supporting mechanism 5 and the second sliding member 7 is more secure and the force is more evenly applied.

FIGS. 1-4, the first connecting frame 2 is provided with a first mounting rod 20, and the second connecting frame 3 is provided with a second mounting rod 21. A positioning piece 22 is fixedly connected to the end of the first mounting rod 20. The positioning piece 22 and the second mounting rod 21 are rotatably connected. A locking column 23 is passed through the positioning piece 22 and the second mounting rod 21. After the user disassembles the components on exercise device 1, the locking column 23 is completely pulled out, and the first mounting rod 20 and the second mounting rod 21 are rotated, so that the first connecting frame 2 and the second connecting frame 3 are folded, so that the volume of the pull-up frame after folding is further reduced, and the space occupied by the storage of the pull-up frame is further saved.

The locking column 23 is a marble latch.

As shown in FIGS. 1-3, the second hollow rod 402 and the fourth hollow rod 502 are respectively provided with a handle 24 for holding. The user can use the handle to apply force to the second hollow rod 402 and the fourth hollow rod 502 very conveniently, thereby expanding and storing the pull-up rack, which is more convenient and labor-saving for the user to use.

As shown in FIGS. 1-3, the first connecting frame 2, the second connecting frame 3, the first hollow rod 401, the second hollow rod 402, the third hollow rod 501, and the fourth hollow rod 502 are all provided with foot pads 25 at the bottom. The provision of the foot pads 25 increases the friction between the pull-up frame and the ground, preventing the pull-up frame from slipping during use, and also has a certain buffering effect, reducing the damage caused by the pull-up frame to the ground during the user's exercise.

When using the application, to store the foldable pull-up frame, the user needs to completely pull out the first locking member 10 and the second locking member 11. Then, rotate the first supporting mechanism 4 and the second supporting mechanism 5, which drives the first connecting member 8 and the second connecting member 9 to rotate. This action causes the first sliding member 6 to slide on the first connecting frame 2, and the second sliding member 7 to slide on the second connecting frame 3. Once the first sliding member 6 and the second sliding member 7 reach the limit distance, the first locking member 10 is used to fix the first sliding member 6, and the second locking member 11 is used to fix the second sliding member 7, completing the storage of the pull-up frame. The components on the exercise device 1 can also be disassembled. Then, the locking column 23 is completely pulled out, and the first mounting rod 20 and the second mounting rod 21 are rotated to fold the first connecting frame 2 and the second connecting frame 3, further reducing the volume of the pull-up frame after folding.

What is claimed is:

1. A pull-up frame, comprising a support base, a first connecting frame and a second connecting frame, wherein the first connecting frame and the second connecting frame are both connected to the support base, and wherein the support base comprises a first supporting mechanism and a second supporting mechanism, wherein the first supporting mechanism is rotatably connected to an end of the first connecting frame, and the second supporting mechanism is rotatably connected to an end of the second connecting frame, wherein a first sliding member is arranged on the first connecting frame, and a second sliding member is arranged on the second connecting frame, and wherein the first sliding member and the first supporting mechanism are connected to the first connecting frame; the second sliding member and the second supporting mechanism are rotatably connected to a second connecting member; the first sliding member is provided with a first locking member for fixing the first sliding member, and the second sliding member is provided with a second locking member for fixing the second sliding member; a cross-sectional shape of the first connecting frame is a non-circular shape, the first sliding member is provided with a first special-shaped hole for matching with the first connecting frame, a cross-sectional shape of the second connecting frame is a non-circular shape, and the second sliding member is provided with a second special-shaped hole for matching with the second connecting frame;

wherein the first connecting frame is provided with a first limiting hole and a second limiting hole; the first sliding member is provided with a first mounting hole for the first locking member to pass through; the first locking member can be engaged with the first limiting hole or the second limiting hole; the second connecting frame is provided with a third limiting hole and a fourth limiting hole; the second sliding member is provided with a second mounting hole for the second locking member to pass through; the second locking member can be engaged with the third limiting hole or the fourth limiting hole;

the first connecting member comprises a first rotating shaft, a second rotating shaft, a first connecting piece and a second connecting piece; wherein the two ends of the first connecting piece are respectively rotatably connected to the first rotating shaft and the second rotating shaft; and the two ends of the second connecting piece are respectively rotatably connected to the first rotating shaft and the second rotating shaft; wherein the first rotating shaft is passed through the first sliding member, and the second rotating shaft is passed through the first supporting mechanism; wherein the first connecting piece is located on one side of the first sliding member and the first supporting mechanism; wherein the second connecting piece is located between the first sliding member and the first supporting mechanism; the second connecting member comprises a third rotating shaft, a fourth rotating shaft, a third connecting piece and a fourth connecting piece, the two ends of the third connecting piece are respectively rotatably connected to the third rotating shaft and the fourth rotating shaft, the two ends of the fourth connecting piece are respectively rotatably connected to the third rotating shaft and the fourth rotating shaft, the third rotating shaft is passed through the second sliding member, the fourth rotating shaft is passed through the second supporting mechanism, the third connecting piece is located on one side of the second sliding member and the second supporting mechanism, and the fourth connecting piece is located on an other side of the second sliding member and the second supporting mechanism.

2. The pull-up frame of claim 1, wherein the first supporting mechanism comprises a first hollow rod and a second hollow rod, the first hollow rod and the second hollow rod being rotatably connected to two sides of the first connecting frame, respectively; the second supporting mechanism comprises a third hollow rod and a fourth hollow rod, the third hollow rod and the fourth hollow rod being rotatably connected to two sides of the second connecting frame, respectively; when the first supporting mechanism and the second supporting mechanism are fully unfolded, the first hollow rod, the second hollow rod, the third hollow rod and the fourth hollow rod are all located on the same plane.

3. The pull-up frame of claim 2, wherein when the first supporting mechanism and the second supporting mechanism are fully extended, the angle formed by the first hollow rod and the second hollow rod is an obtuse angle, the angle formed by the third hollow rod and the fourth hollow rod is an obtuse angle, and an opening direction of the angle formed by the first hollow rod and the second hollow rod is opposite to the opening direction of the angle formed by the third hollow rod and the fourth hollow rod.

4. The pull-up frame of claim 3, wherein a number of the first connecting members is two, and the two first connecting members are rotatably connected to the first hollow rod and the second hollow rod respectively; a number of the second connecting members is two, and the two-second connecting members are rotatably connected to the third hollow rod and the fourth hollow rod respectively.

5. The pull-up frame of claim 4, wherein the first connecting frame is provided with a first mounting rod, the second connecting frame is provided with a second mounting rod, a positioning piece is fixedly connected to the end of the first mounting rod, the positioning piece and the second mounting rod are rotatably connected, and a locking column is commonly provided on the positioning piece and the second mounting rod.

6. The pull-up frame of claim 5, wherein the second hollow rod and the fourth hollow rod are respectively provided with a handle for holding.

7. The pull-up frame of claim 6, wherein the first connecting frame, the second connecting frame, the first hollow rod, the second hollow rod, the third hollow rod, and the fourth hollow rod are all provided with foot pads at a bottom.

* * * * *